US006076692A

United States Patent [19]

Avot

[11] Patent Number: 6,076,692

[45] Date of Patent: Jun. 20, 2000

[54] RECEPTACLE WITH VARIABLE DIMENSIONS

[75] Inventor: Jean-Pierre Avot, Les Loges en Josas, France

[73] Assignee: Bethel International Inc., Tortola, Virgin Islands (Br.)

[21] Appl. No.: 09/194,210

[22] PCT Filed: May 16, 1997

[86] PCT No.: PCT/IB97/00565

§ 371 Date: Nov. 20, 1998

§ 102(e) Date: Nov. 20, 1998

[87] PCT Pub. No.: WO97/44257

PCT Pub. Date: Nov. 27, 1997

[30] Foreign Application Priority Data

May 20, 1996 [FR] France ..... 96 06522

[51] Int. Cl.[7] ..... B65D 11/14

[52] U.S. Cl. ..... 220/8; 220/4.03

[58] Field of Search ..... 220/4.03, 8, 629

[56] References Cited

U.S. PATENT DOCUMENTS

| | | | |
|---|---|---|---|
| 1,664,465 | 4/1928 | Purchas | 220/8 X |
| 2,405,535 | 8/1946 | Weiss . | |
| 2,739,776 | 3/1956 | Terando . | |
| 2,873,934 | 2/1959 | Settles . | |
| 3,342,146 | 9/1967 | Lessheim . | |
| 3,887,102 | 6/1975 | Earley | 220/8 |
| 4,478,337 | 10/1984 | Flum | 220/8 X |
| 5,007,550 | 4/1991 | Avot . | |

FOREIGN PATENT DOCUMENTS 2350968 12/1977 France .

*Primary Examiner*—Steven Pollard
*Attorney, Agent, or Firm*—Young & Thompson

[57] ABSTRACT

The present invention relates to a multi-use receptacle having longitudinally and laterally variable dimensions, comprising a planar bottom and lateral and longitudinal extension devices which cooperate with said bottom by slidingly moving elongate members which are comprised in said extension devices and which are integral with walls forming the walls of the receptacle in an assembly position.

18 Claims, 12 Drawing Sheets

FIG. 3a
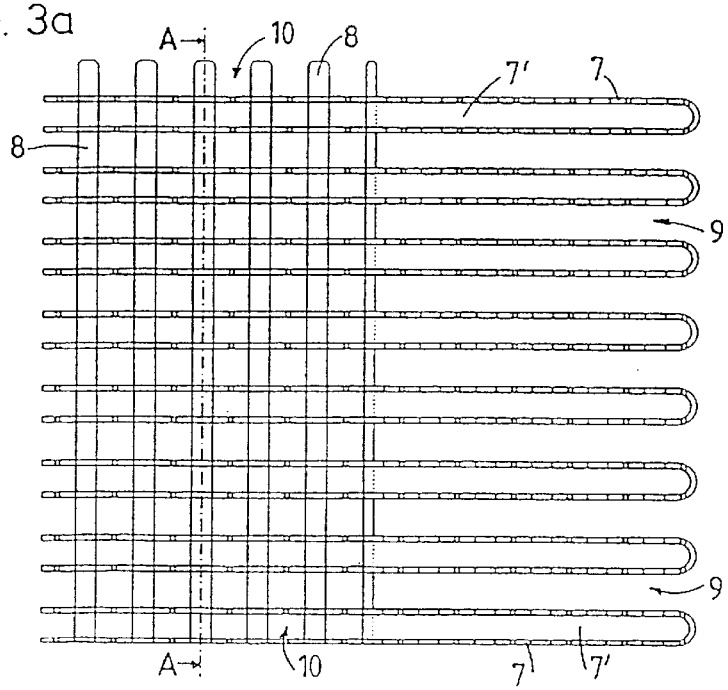
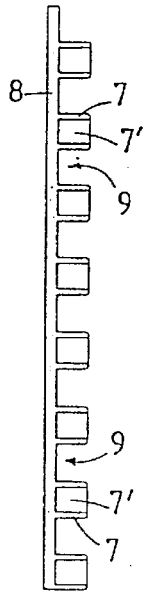
FIG. 3c
FIG. 3b
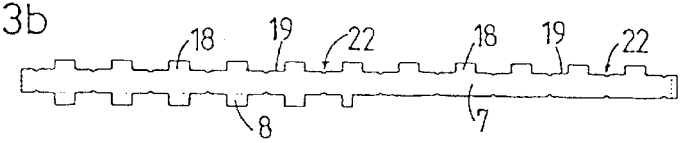
FIG. 4a
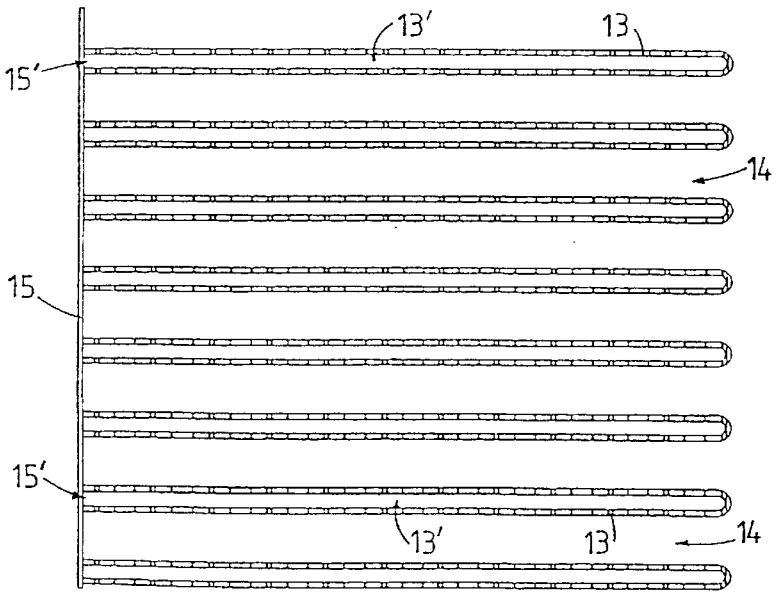
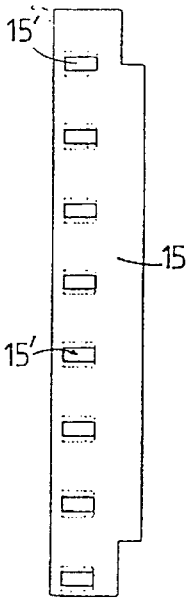
FIG. 4c
FIG. 4b
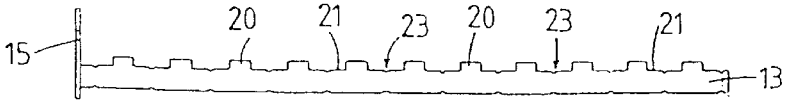

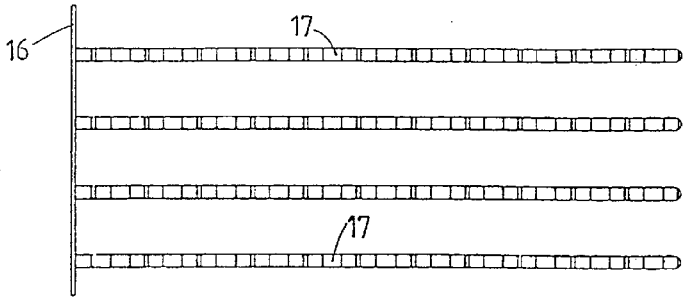
FIG. 5a
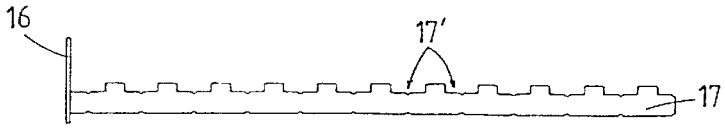
FIG. 5b
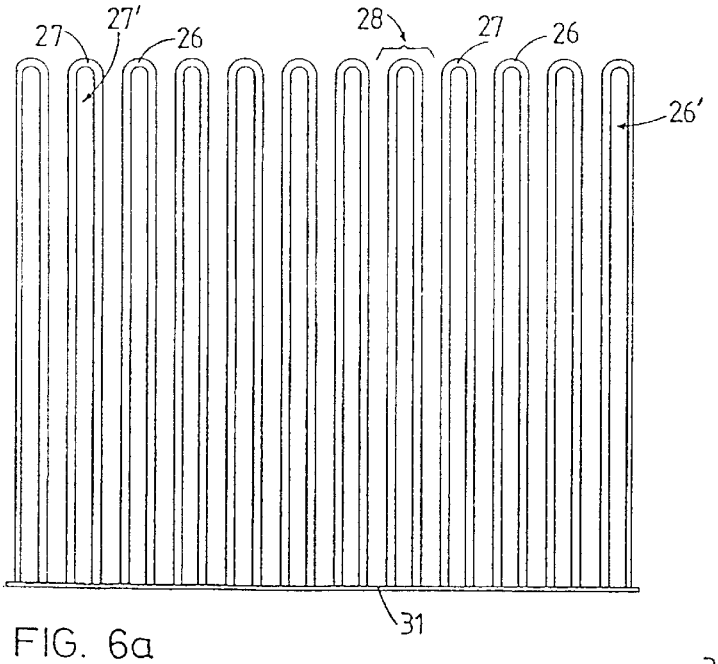
FIG. 6a
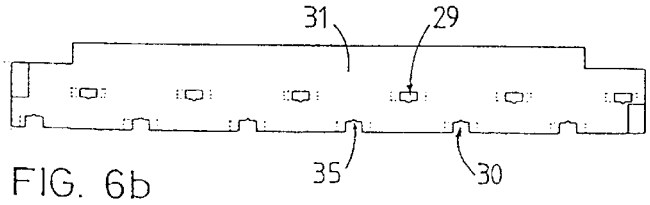
FIG. 6b
FIG. 7
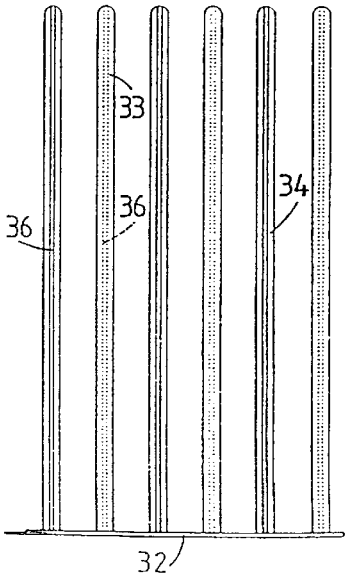

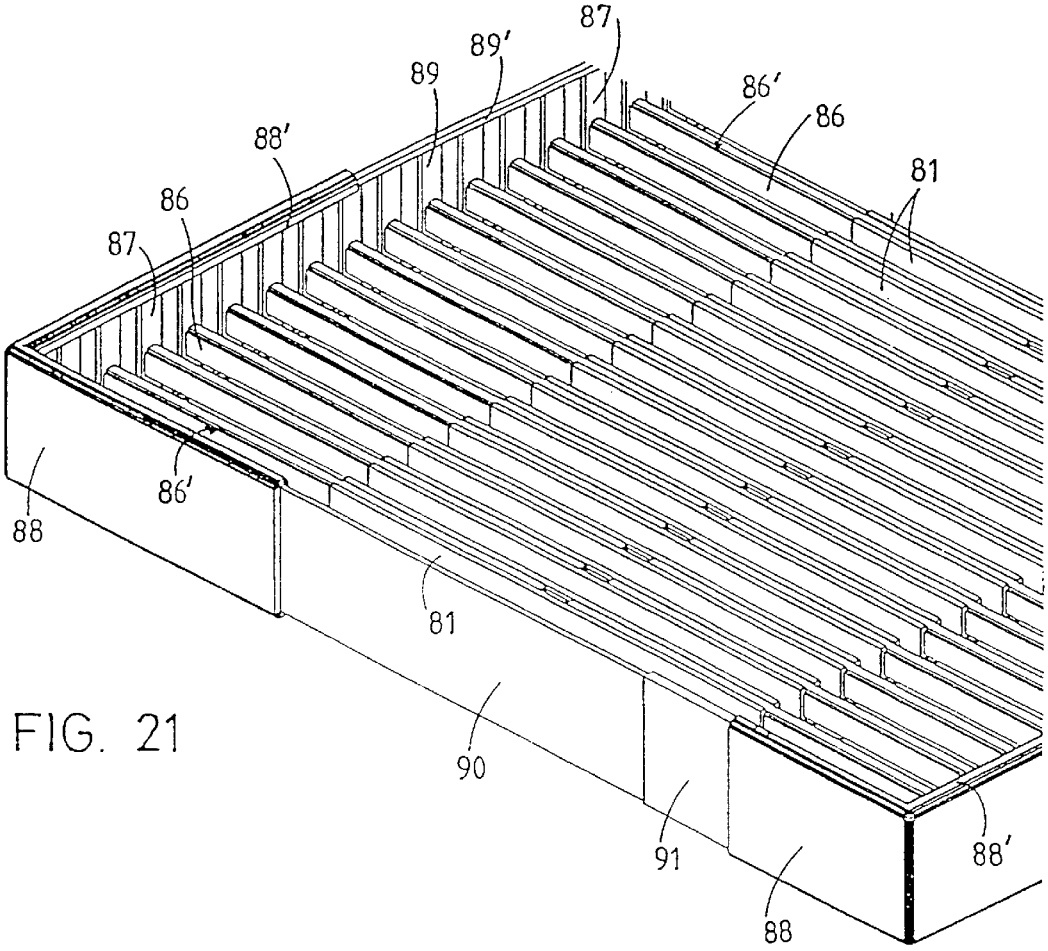
FIG. 21
FIG. 22
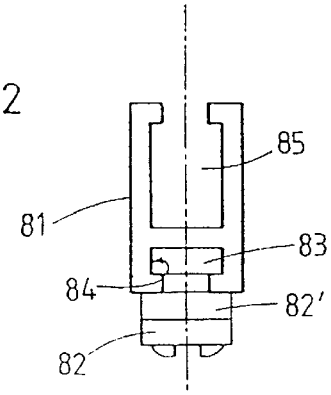

RECEPTACLE WITH VARIABLE DIMENSIONS

The present invention is concerned with a receptacle designed for multiple uses, of which the dimensions can be varied and which can be used, in particular for the packaging, the handling, the storage, the transport and the display, more particularly in shops, of all types of consumer goods and also of all types of other items. The receptacle is in fact an improvement of a receptacle object of patent application FR-A-8810920, by the same inventor.

Such receptacles are actually already known, in particular from the above-mentioned document, of which the width is adjustable and which are comprised of two components co-operating with each other by means of fingers provided in the bottom part of each component, in such a manner as to be mutually interdigitated and allow an adjustment of the width of the receptacle by bringing together or pulling apart these two components, whereby the fingers slide one set relative to the other.

However, the adjustment of the width of the receptacle is limited in practice to an increase of about one third from the minimal width, owing to the design of the two constituent components and to the need of ensuring a sufficient rigidity of the assembly.

In fact, it has become rapidly apparent that this limitation was a serious drawback in practical use and required the manufacture and handling of several types of receptacles of different dimensions. Accordingly, the objective of the invention is to provide a receptacle of the above-mentioned type, but the length of which, on the one hand, can be extended beyond the above-mentioned limit and, on the other hand, can be adjusted in its length, i. e. in the direction perpendicular to that of the known receptacle, so that only one type of receptacle can be used, in its various dimensions, for stacking optimally on a standard pallet.

This objective is attained with the receptacle for multiple uses object of the invention, which has dimensions which can be varied longitudinally and laterally and which includes a planar bottom and lateral and longitudinal extension devices co-operating with said bottom by a sliding motion of elongate members which are part of these extension devices and which are integral with walls forming the walls of the receptacle in the assembly position.

The invention will now be described with reference to the appended drawings, which illustrate embodiments of the receptacle of variable dimensions.

FIG. 3*a* is a plan view of a bottom component of the first embodiment and FIGS. 3*b* and 3*c* are, respectively, a cross-sectional view (along A—A) and a side view of this component.

FIG. 4*a* is a plan view of a main component of a longitudinal extension device of the first embodiment and FIGS. 4*b* and 4*c* are, respectively, a side view and a front view of this component.

FIGS. 5*a* and 5*b* are, respectively, a plan view and a side view, of a secondary component of a longitudinal extension device of the first embodiment.

FIGS. 6*a* and 6*b* are, respectively, a plan view and a front view of a main component of a lateral extension device of the first embodiment and FIG. 7 is a plan view of a secondary component of this device.

Figure 8:
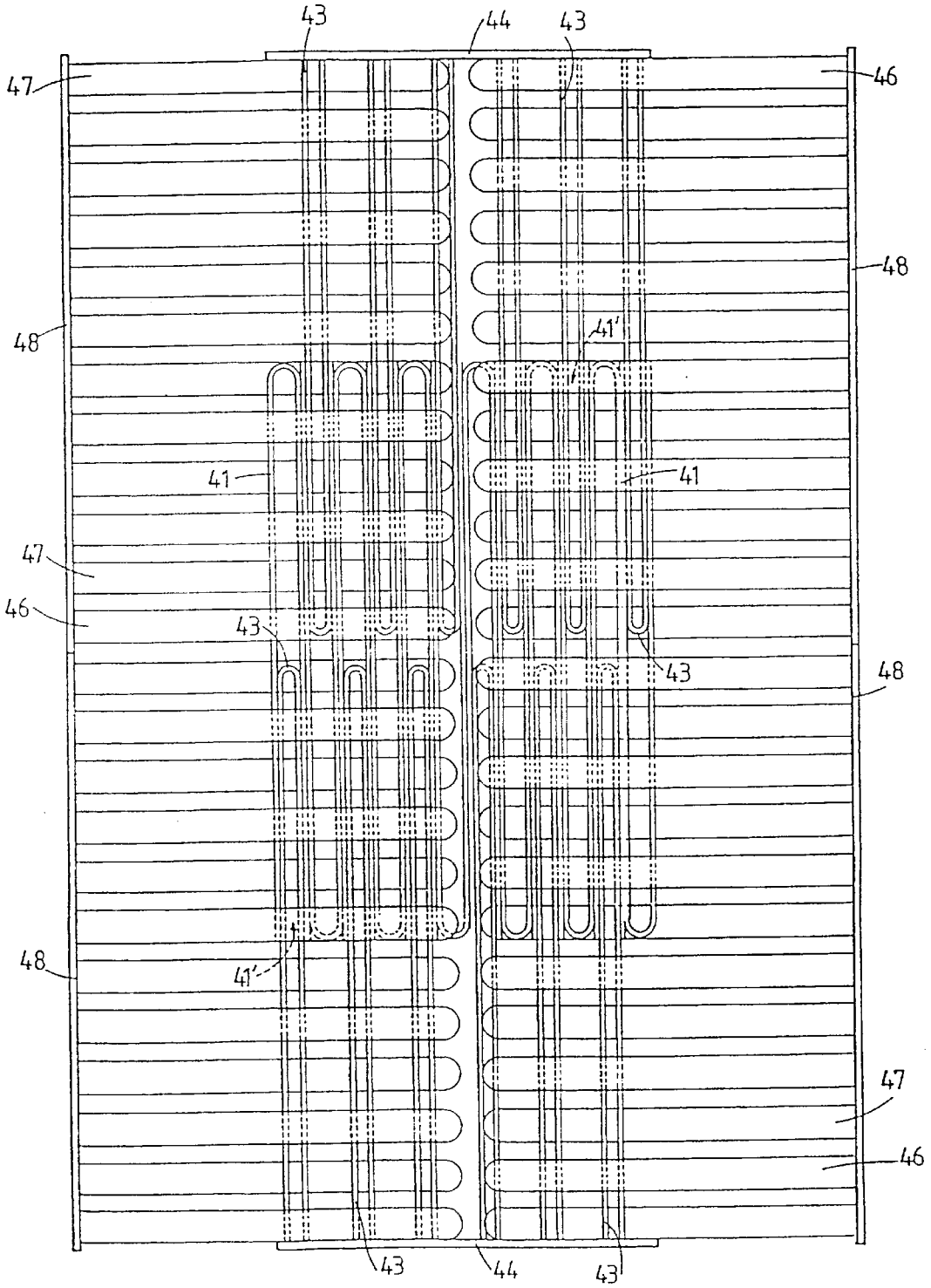

FIG. 8 is a plan view, in one of the assembly positions, of a second embodiment which is a simplified version of the first embodiment.

Figure 9:
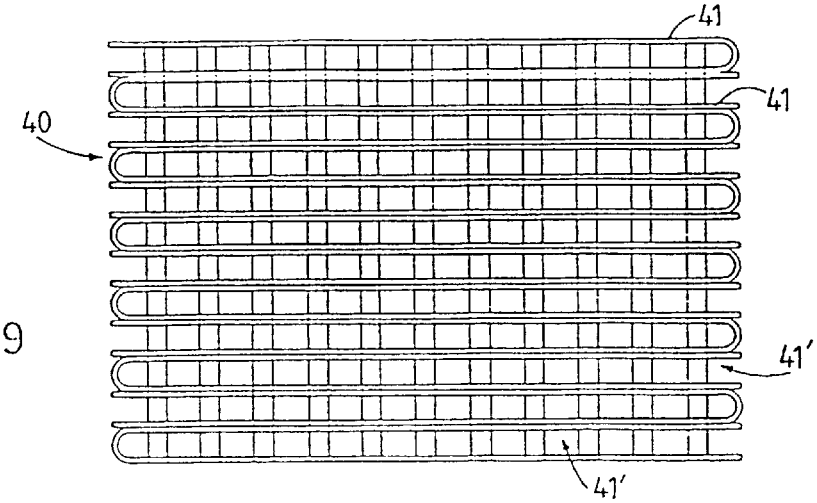
Figure 10:
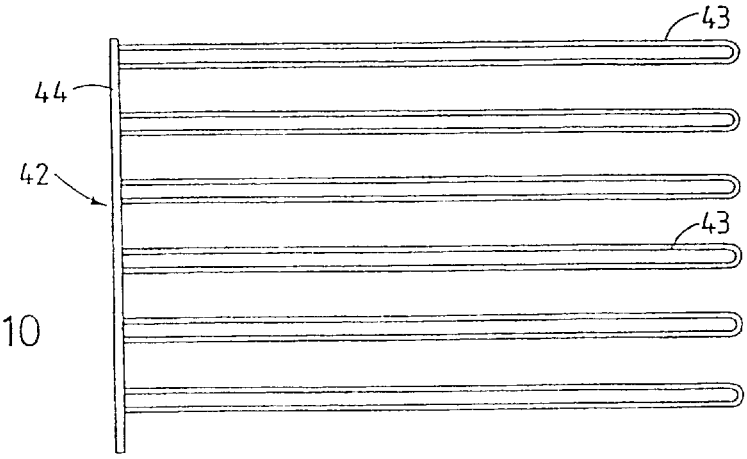

FIG. 9 is a plan view of the bottom of the simplified version of FIG. 8 and FIG. 10 is a plan view of a longitudinal extension component of this version.

Figure 11A:
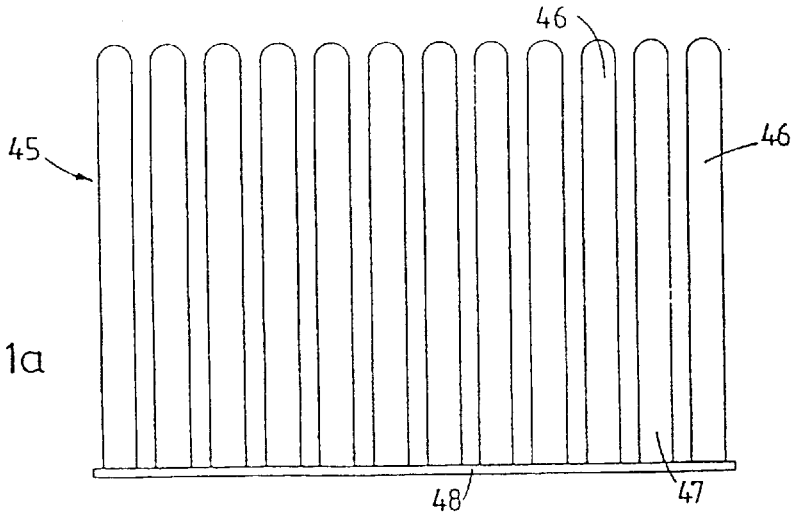
Figure 11B:
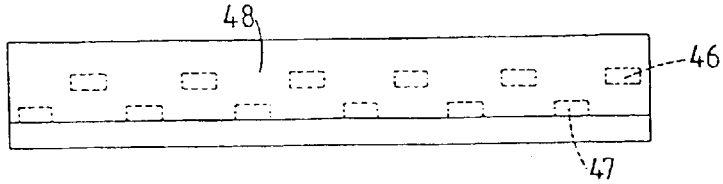

FIGS. 11*a* and 11*b* are, respectively, a plan view and a front view of a lateral extension component of the version of FIG. 8.

Figure 12:
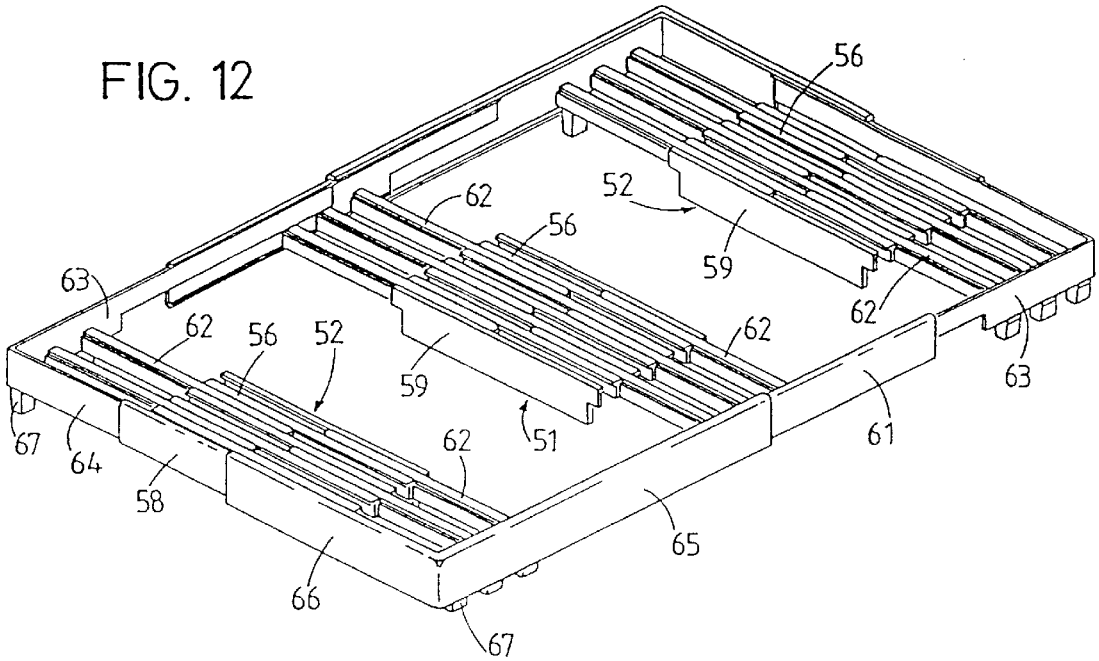
Figure 13:
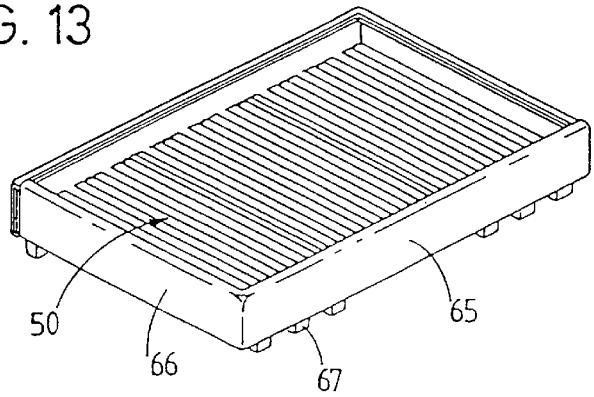

FIGS. 12 and 13 are plan views illustrating two different assembly positions of a third embodiment of the receptacle according to the invention.

Figure 14:
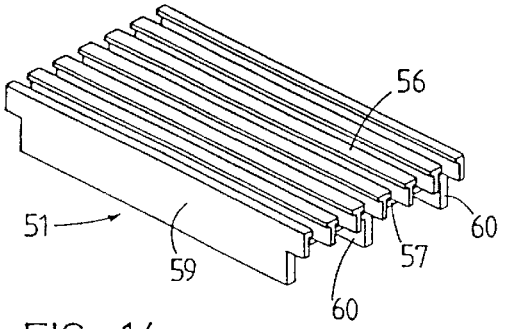
Figure 15:
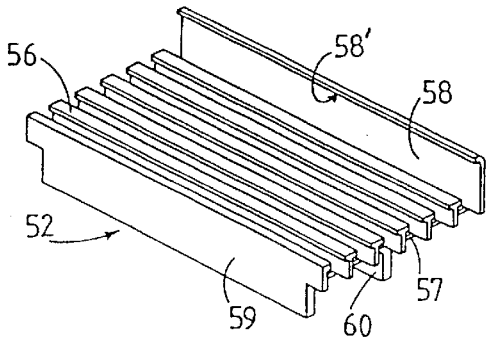

FIGS. 14 and 15 are detailed perspective views showing two of the bottom components of the second embodiment.

Figure 17:
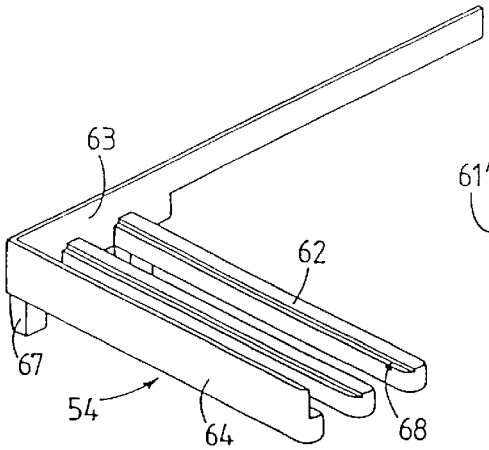
Figure 16:
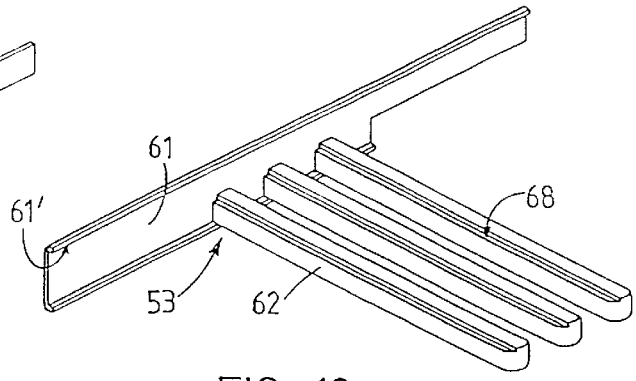
Figure 18:
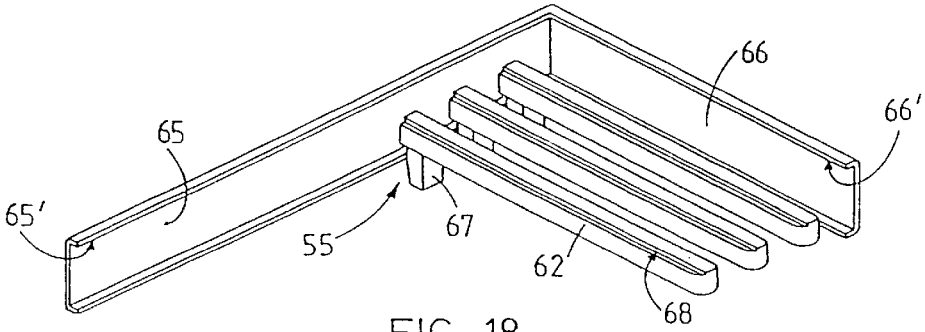

FIGS. 16, 17 and 18 are detailed perspective views illustrating the three types of extension components of the third embodiment.

Figure 19:
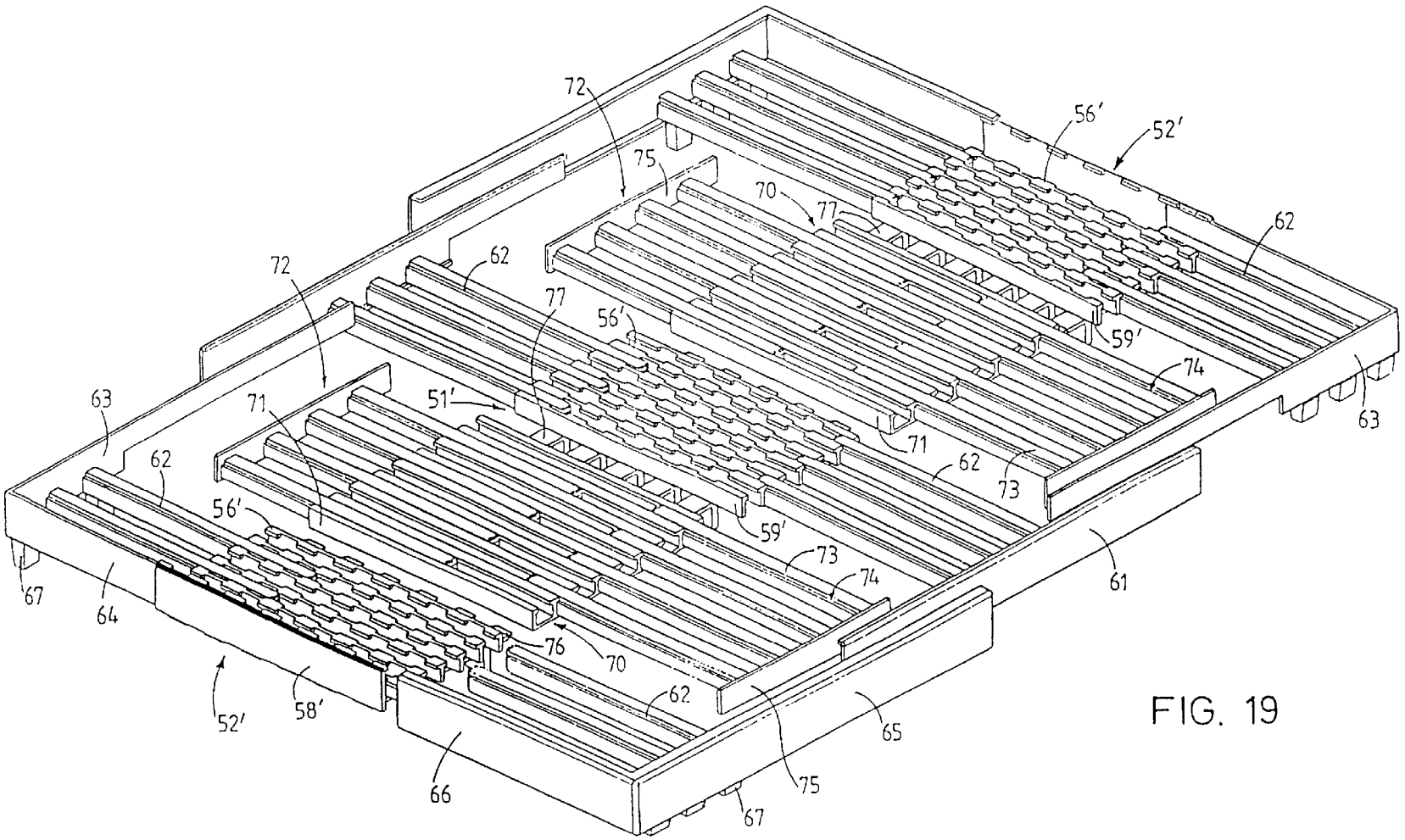

FIG. 19 is an exploded view in perspective of an alternate version of the third embodiment of the invention of FIGS. 12 to 18.

Figure 20:
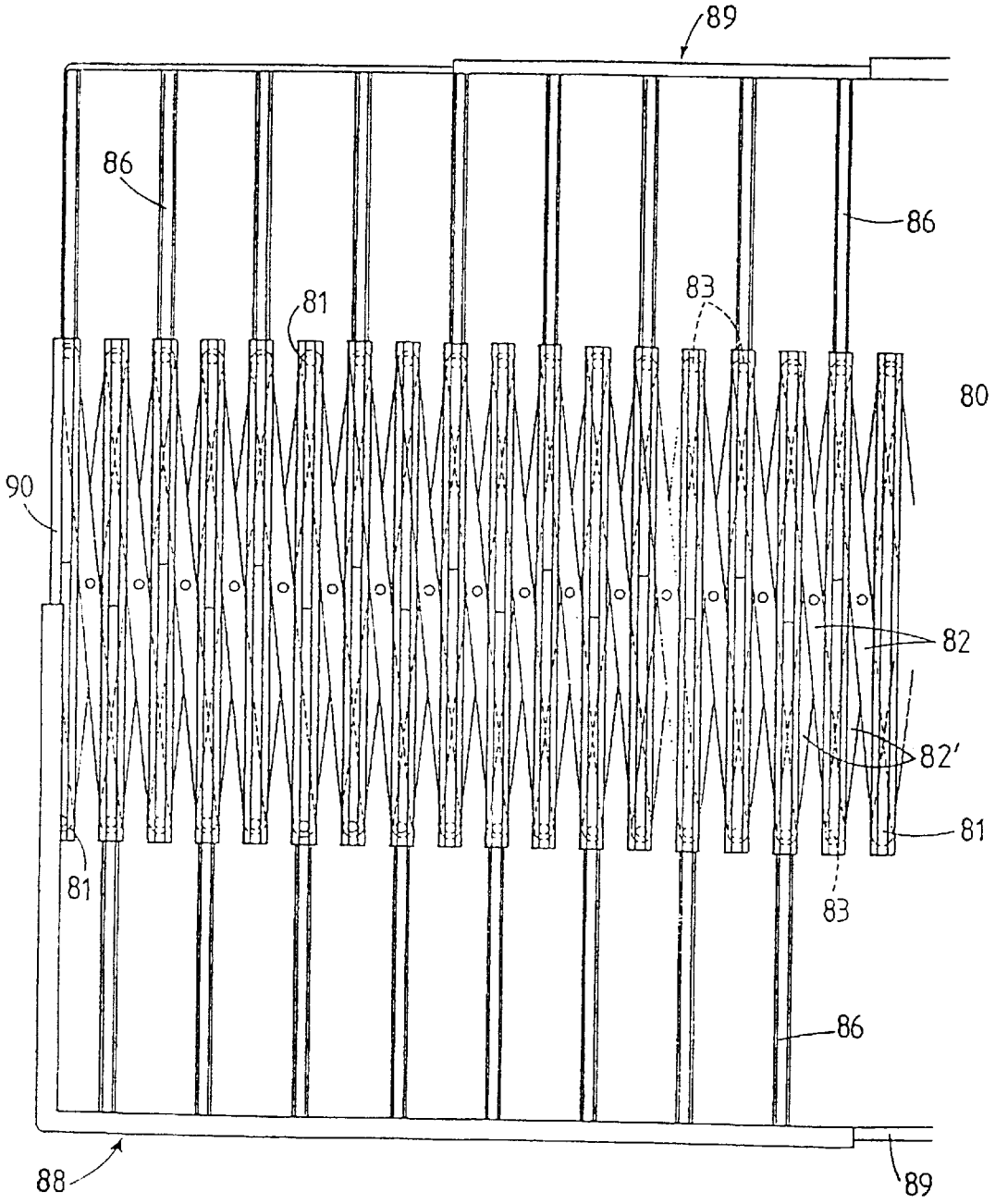

FIG. 20 is a plan view, in an operative position, of a fourth embodiment and FIGS. 21 and 22 are, respectively, a perspective view and a cross-sectional view of a detail of this fourth embodiment.

Figure 23:
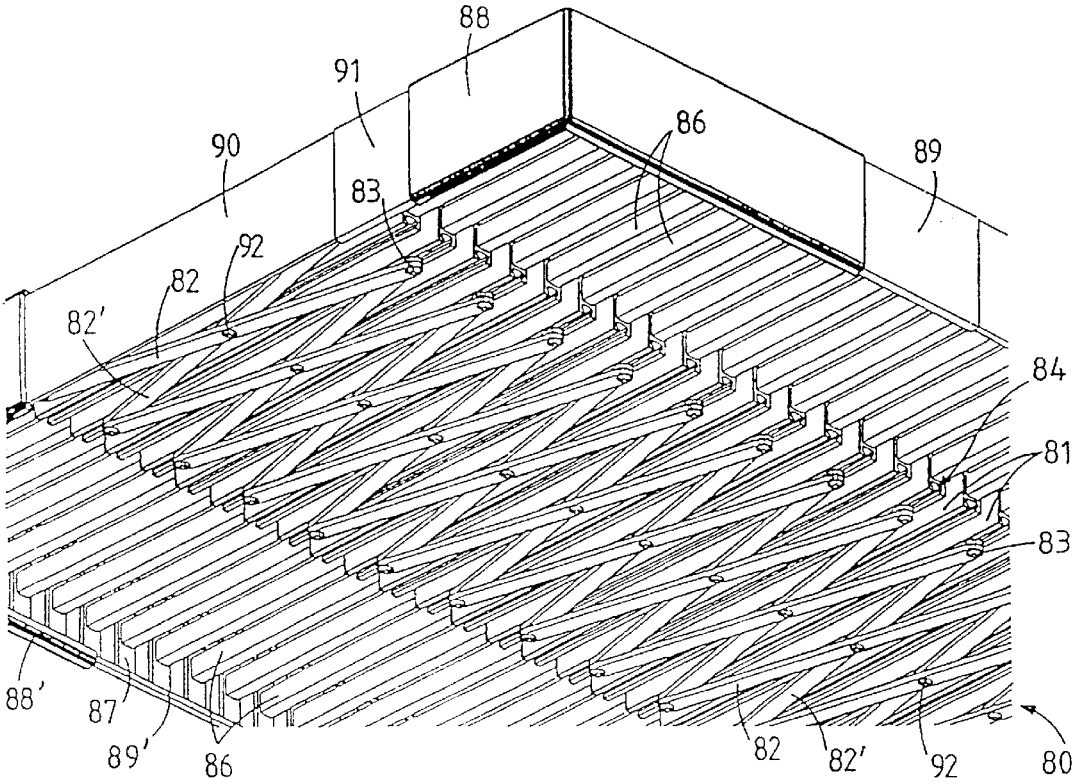

FIG. 23 is a partial perspective view of the bottom of a first alternate version of the fourth embodiment.

Figure 24:
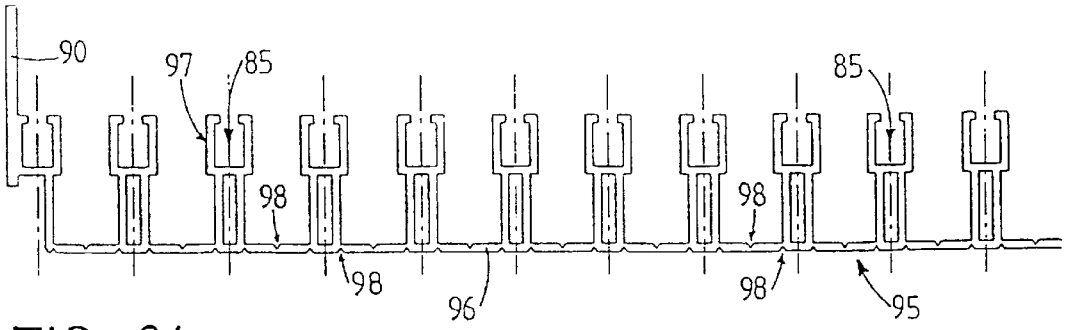
Figure 25:
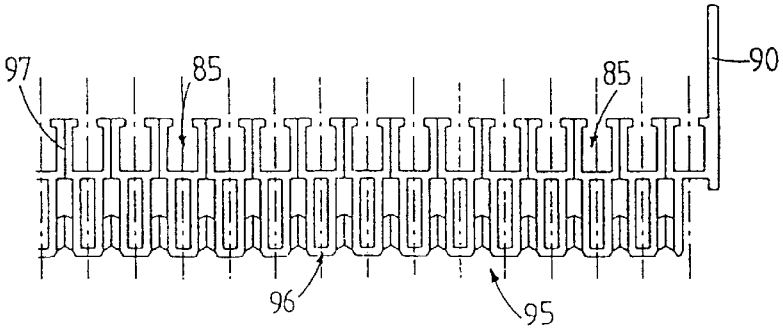

FIGS. 24 and 25 are partial cross-sectional views of the extensible bottom of a second alternate version of the fourth embodiment, in two operative positions.

Figure 1:
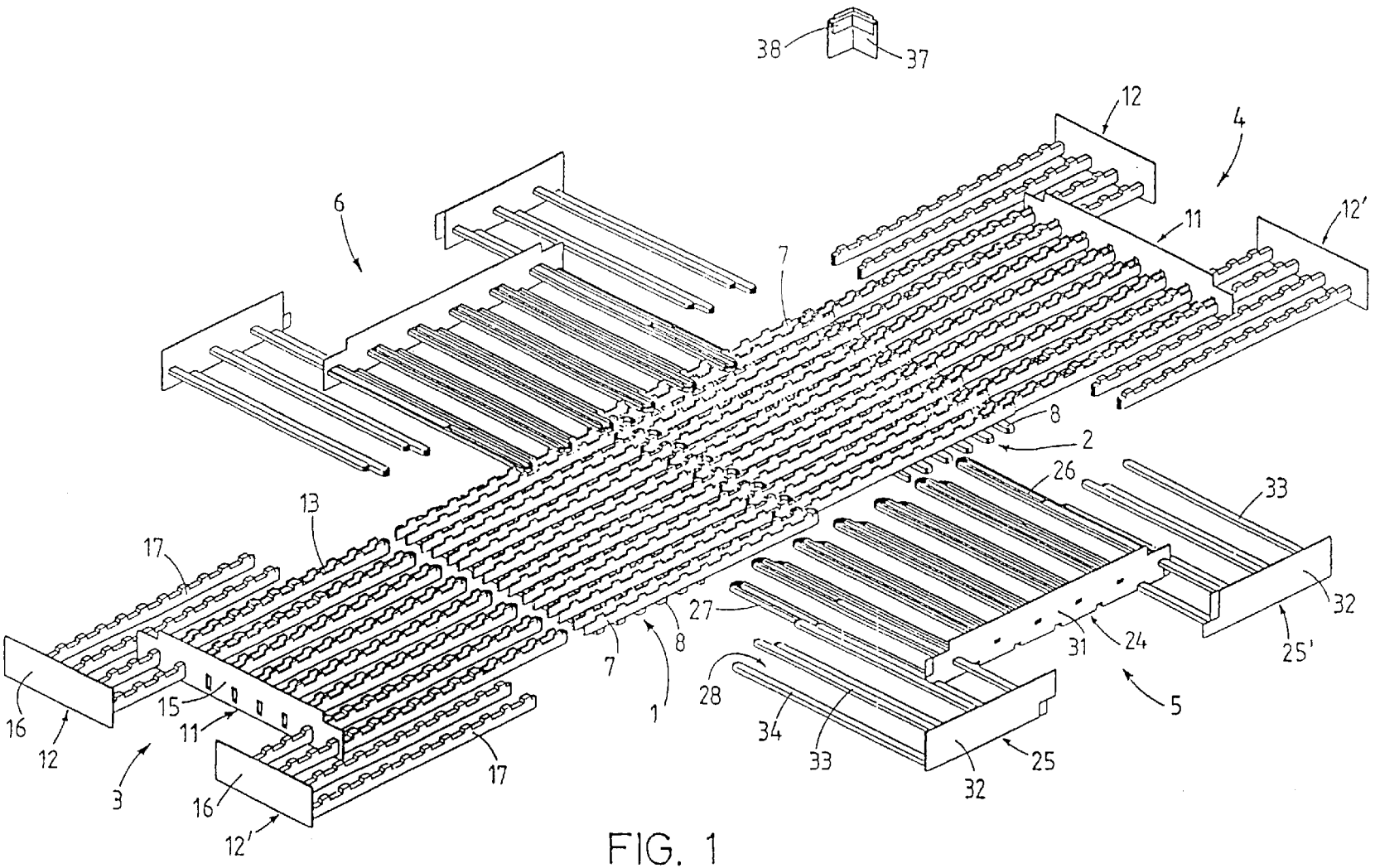
FIG. 1 is an exploded view in perspective of a first embodiment of the receptacle according to the invention.

As illustrated in FIG. 1, the first embodiment of the invention is comprised of two bottom components 1, 2, of two longitudinal extension devices 3, 4 and of two lateral extension devices 5, 6.

The two bottom components 1, 2 are constructed in a manner similar to that of the two components of the bottom structure of the receptacle according to patent application FR-A-8810920, except that the base and the crenated section (a section shaped with grooves and ribs) are replaced by a structure comprised of longitudinal hollow fingers 7 and cross beams 8, the longitudinal fingers 7 being arranged to run parallel to one another, with a longitudinal space 9 being provided between the fingers of a width slightly greater than that of the fingers 7 and the cross beams 8 being integral with the longitudinal fingers 7 and being arranged to run parallel to one another with intervals 10 therebetween slightly greater than the width of the transverse fingers 27 described hereafter; the cross beams 8 are located beneath the longitudinal fingers 7 only over a part (approximately one half) of the length of the body of fingers.

The two longitudinal extension devices 3, 4 are each one comprised of a main component 11 and of two secondary components 12, 12'. The main component 11 has hollow longitudinal fingers 13, spaced apart by an interval 14 of a width which is slightly lesser than that of the cavity 7' of the fingers 7 of the bottom components 1, 2. The longitudinal fingers 13 of the main components 11 are integral with a wall 15 which is perpendicular to the open end of said fingers 13, the cavity 13' thereof communicating with corresponding openings 15' of the wall 15.

As to the secondary longitudinal extension components 12, 12', they have each one a wall 16 and longitudinal rods 17 integral with said wall 16 and perpendicular thereto, the width of said rods being slightly lesser than that of the orifices 15' of the cavities 13' of the hollow fingers 13.

The different constituent parts described hereabove are illustrated in more detail in FIGS. 3*a–c,* 4*a–c* and 5*a–b*. In particular, it is apparent in these figures that in the preferred versions of the invention, the hollow longitudinal fingers 7 and 13 of, respectively, the bottom components 1, 2 and of the main components 11 of the longitudinal extension devices 3, 4 are U-shaped when viewed in plan, with one end of each finger 7, 13 being closed by a rounded portion and the other end being open. Furthermore, the upper edges of these fingers 7, 13 are crenated, with crenatures 18, 20 defining between them transverse recesses 19, 21, of which the bottom can advantageously be provided with a central groove 22, 23. As illustrated in FIG. 5*b,* the rods 17 of the secondary components 12, 12' of the longitudinal extension devices 3, 4 are also crenated with the same transverse recesses 17' as the hollow fingers 7, 13.

Concerning the lateral extension devices 5, 6, they include each one a main component 24 and two secondary components 25, 25'. The main component 24 has two series of hollow transverse fingers 26, 27 located in two parallel horizontal planes which are spaced apart by a distance slightly greater than the thickness of the longitudinal fingers 7, exclusive of the crenatures, of the bottom components 1, 2, the transverse fingers 26 of the upper plane being offset relative to those 27 of the lower plane. Furthermore, the transverse fingers 26, 27 are all spaced apart in the horizontal direction, by an interval 28 corresponding to the distance between two non contiguous recesses 19 of the longitudinal fingers 7 of the bottom components 1, 2. The hollows 26', 27' of the fingers 26, 27 communicate with openings 29, 30 provided in the wall 31 of the main component 24, with which wall the transverse fingers 26, 27 are integral.

The two secondary components 25, 25' of the lateral extension devices 5, 6 are comprised each one of a wall 32 and of rods 33, 34 which are integral with said wall 32 while being perpendicular thereto. These rods are arranged, here again, in two horizontal planes spaced apart vertically by the same distance as that between the planes containing the hollow transverse fingers 26, 27 of the main component 24 and they are offset in the same manner as said fingers 26, 27 by the same interval 28.

The constituent components 24, 25, 25' of the lateral extension devices 5, 6 are illustrated in more detail in FIGS. 6*a–b* and 7. It is apparent, in particular in FIG. 6*b,* that the openings 29, 30, arranged in the wall 31 of the main component 24, can advantageously be made with grooves 35 and, in FIG. 6*a,* that the hollow transverse fingers 26, 27 are also U-shaped, with their open end communicating with the openings 29, 30 of the wall 31.

As illustrated in FIG. 7, the rods 33, 34 can carry each one an axial rib 36, situated on the upper face of the lower rods 34 and on the lower face of the upper rods 33.

Figure 2:
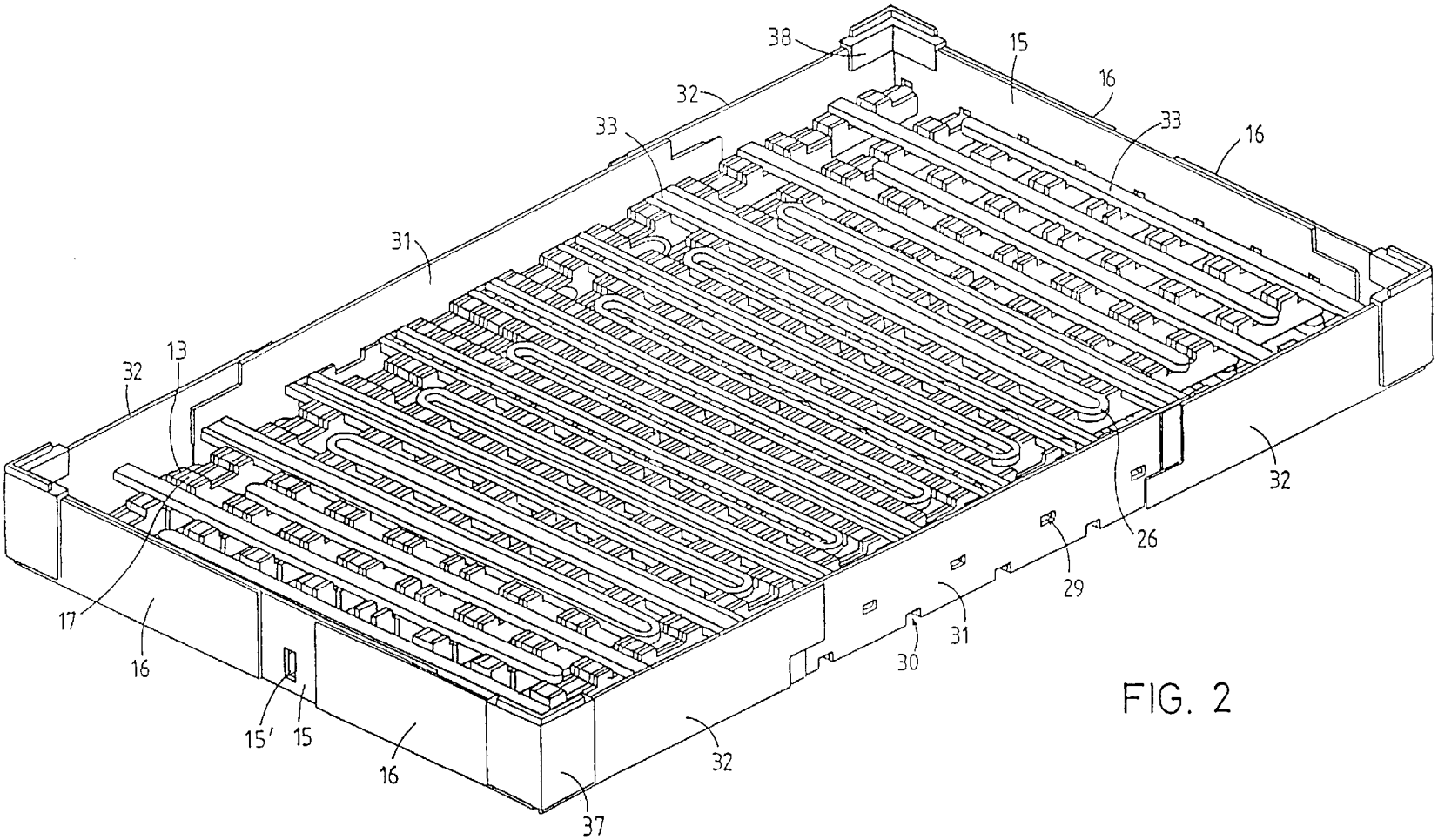
FIG. 2 is a perspective view of the embodiment of FIG. 1 in one assembly position.

Finally, the receptacle according to the invention and as illustrated by way of example in FIGS. 1 and 2, includes furthermore four corner pieces 37 which have each one a back-folded flap 38 and which are designed for holding together the different constituent components of the receptacle, once the dimensions of the receptacle have been selected, specifically by co-operating with the upper edges of the corner ends of the walls 16, 32 of, respectively, the longitudinal extension components 12, 12' and of the secondary lateral extension components 25, 25'.

The assembling of the receptacle according to the invention will now be explained, again with reference to the embodiment illustrated in FIGS. 1 and 2.

Firstly, the main part of the bottom of the receptacle is formed by assembling the two bottom components 1, 2 in such a manner that the longitudinal fingers 7 of one of them are housed between the longitudinal fingers 7 of the other component, by a sliding motion of the same in the intervals 9. Thereafter, the main components 12 of the longitudinal extension devices 3, 4 are introduced from each side of the bottom components 1, 2 by a sliding motion of their longitudinal fingers 13 in the cavities 7' of the longitudinal fingers 7 of said bottom components. The overall final length of the receptacle is hence adjusted by the sliding motion of the two bottom components 1, 2 and that of the two main components 12 of the longitudinal extension devices 3, 4.

One then introduces, from each side of the main component 11 of the longitudinal extension devices 3, 4, the two secondary components 12, 12', by sliding the rods 17 of these components into the orifices 15' provided in the wall 15 of said main component 12 and into the cavities 13' of the fingers 13, the extent of the introduction being dependent upon the final length desired for the receptacle.

The above-mentioned constituent components can then be locked in the selected position by the introduction of the lateral extension devices 5, 6. Specifically, the upper transverse fingers 26 of the main components 24 of these devices co-operate with the transverse recesses 19 of the longitudinal fingers 7 of the bottom members 1, 2, and possibly with the recesses 21 of the longitudinal fingers 13 of the main components and also with the recesses 17' of the rods 17 of the secondary components of the longitudinal extension devices 3, 4.

On the other hand, the lower fingers 27 of the main components 24 of the lateral extension devices 5, 6 are introduced above the longitudinal fingers 7 of the bottom component and in such a manner as to co-operate with the spaces 10 between the transverse beams 8 integral with these fingers 7.

Finally, the secondary components 25, 25' of the lateral extension devices 5, 6 can be assembled so as to complete the receptacle: specifically, the rods 33, 34 are introduced into the orifices 29, 30 of the wall 31 of the main component 24 and into the hollows 26', 27' of the corresponding fingers, depending on the overall length desired for the receptacle.

In a preferred version of the first embodiment, i.e. with the grooves 22, 23 in the recesses 19, 21 of the longitudinal hollow fingers 7, 13 and the grooves 35 in the openings 29, 30 of the wall 31 of the main components 24 of the transverse extension devices 5, 6 co-operating with the ribs 36 of the transverse rods 33, 34 of the secondary components 25, 25' of these devices, one can prevent the lateral sliding of the rods 33, 34 in the recesses 19, 21, in particular when the receptacle is assembled in its largest dimensions and when the secondary components 25, 25' are located outwards of the main components 24.

When the different constituent parts are assembled, they are locked in the respective positions selected by affixing at the four corners of the receptacle is formed, the corner pieces 37, of which the back-folded flaps 38 co-operate simultaneously with the upper edges of the walls 32 of the secondary components 25, 25' of the lateral extension devices 5, 6 and with the upper edges of the walls 16 of the secondary components 12, 12' of the longitudinal extension devices 3, 4, as illustrated, for example, in FIG. 2.

In practise, one can manufacture a receptacle according to this first embodiment of the invention for instance and preferably from a plastic material, to have a length which can be changed from 300 to 600 mm or to the intermediate lengths of 400 and 500 mm (with a 50 mm spacing of the fingers) and a width which can be changed from 266.66 to 400 mm or to the intermediate width of 300 mm (with a 32 mm spacing of the fingers). In all such dimensions, these receptacles can be stacked in a rational manner on a standard 800×1200 cm or 1000×1200 cm pallet FIGS. 8 to 11 illustrate a second embodiment of the invention corresponding to a simplified version of the first embodiment described here above with reference to FIGS. 1 to 7, in which the bottom 40 is made of a single piece and is comprised of hollow fingers 41 having in plane the shape of a U and held together longitudinally side by side in such a manner that the open end of each finger is contiguous to the closed end of the following finger (see FIG. 9).

The longitudinal extension device includes, on each side of the bottom 40, a longitudinal extension component 42 having longitudinal fingers 43 integral at one of their ends with a wall 44 (FIG. 10) and designed for co-operating slidably with the longitudinal cavities 41' of the hollow fingers 41, for the adjustment of the length of the assembled receptacle.

Finally, this version includes lateral extension devices, each one consisting of two lateral extension components 45, such as illustrated in FIGS. 11*a* and 11*b*. Each component 45 has two series of transverse fingers 46, 47 arranged in two horizontal parallel planes spaced apart by a distance corresponding approximately to the thickness of the fingers 41 forming the bottom 40, the fingers 46 of the upper plane being offset with respect to those 47 of the lower plane and the two series of fingers 46, 47 being integral at one of their ends with a wall 48.

As in the case of the first embodiment of FIGS. 1 to 7, this simplified version with a restricted number of pieces provides a receptacle of which the dimensions can be modified, both in length and in width. Preferably, each constituent part such as described previously is manufactured from an appropriate plastic material.

Referring now to FIGS. 12 to 18, the third exemplary embodiment of the receptacle according to the invention, includes a bottom 50 comprised of three separate components, namely a central bottom component 51 and two lateral bottom components 52, as well as two longitudinal-lateral extension devices comprised each one of a central extension component 53 and of two corner components 54, 55.

The bottom components 51, 52 are comprised of the assembly of T-section bars 56 running all parallel while being held together by the lower transverse beams 57, with the lateral bottom components further having each one an external wall 58 parallel to the T-section bars 56 and integral therewith (see FIGS. 14 and 15).

Furthermore, each one of the components has an inner wall 59, also running parallel to the T-section bars 56 and extending downwards in such a manner as to provide a support member for the receptacle. Finally, these components further exhibit one or two vertically oriented spars 60, which act as support members and are integral with the lower transverse beams 57.

The central component 53 of the longitudinal-lateral extension devices has a wall 61 and three transverse fingers 62, integral with said wall 61 and perpendicular thereto (FIG. 16).

The corner components 54, 55 (FIGS. 17 and 18) have both two mutually perpendicular walls 63, 64 and 65, 66, and, further, transverse fingers 62 which are identical to those of the central component 53 and which are integral with one of said walls 6, 65 and perpendicular thereto. These two corner components 54, 55 are further provided with feet 67 arranged beneath the portion of each transverse finger 62 adjoining the wall 63, 65.

Finally, the upper edges of each transverse finger 62 of the three components 53, 54, 55 exhibit a shoulder 68 along the whole length of said finger 62, to co-operate with the upper portion of the T-section bars 56 of the bottom components 51, 52.

The assembling of the receptacle according to the third embodiment is illustrated in the two FIGS. 12 and 13. The former illustrates the receptacle with its largest dimensions, both in length and in width (for example 300×600 mm) and the latter with its smallest dimensions (200×400 mm). As illustrated in particular in FIG. 12, the walls of the bottom components 52 and of the extension components 53 and 55 are mounted slidably into one another owing to the inwardly bent ledges 58', 61', 65' running along the upper edges of the wall 58 of the bottom component 52 and along the upper edges of the walls 61 and 65 of the extension components 53 and 55. Specifically, the walls 63, 64 of a corner component 54 slide along the inside of the walls 58, 61 of the bottom component 52 and of the central extension component 53, with the walls 58, 61 sliding, in turn telescopically along the inside of the walls 65 and 66 of the other corner component 55.

Depending on the type of articles or items to be stored and transported on the receptacle of the second embodiment and, more particularly when the same is in its most extended assembly position (FIG. 12), it may prove necessary to place on the bottom components 52, a board or a grid, for example made of corrugated cardboard or of a plastic material.

An alternate version of the third embodiment described previously is illustrated in FIG. 19; this version differs in that it includes bottom components and removable additional extension components.

Specifically, two additional bottom components 70 are arranged between the central bottom component 51' and the two lateral bottom components 52' when this central bottom component 51' and the lateral bottom components 52' are in such positions as to be spaced apart from one another (for example in positions similar to those illustrated in FIG. 12); when the receptacle is assembled as shown in FIG. 13, with the central bottom component 51' and the lateral bottom components 52' being contiguous, then the two additional bottom components 70 are located above the aforementioned components.

Each additional bottom component 70 is formed by the assembling of several U-section bars 71, of which the free upper edges are bent inwardly.

On the other hand, this embodiment further includes transverse extension components 72 co-operating with each one of the two additional bottom components 70, with the transverse fingers 73 of these transverse extension components 72 sliding inside the elongate cavity defined by each U-section bar 71. Preferably, these transverse fingers 73 have longitudinal upper shoulders 74, which co-operate with the bent portions of the U-section bars 71 and prevent said fingers 73 from moving upwards to be removed from the elongate cavities of the U-section bars 71. They are furthermore integral with a wall 75 which is perpendicular to said fingers 73, this wall 75 being movable laterally by sliding against the inner side of the wall 61 of the central component 53.

Finally, the bottom components 51', 52' differ from those 51, 52 of the third embodiment, on the one hand, in that the T-section bars constituting these components are provided with structures 56', the purpose of which is essentially to facilitate the manufacture of these components and, more particularly their de-moulding; on the other hand, these bottom components 51', 52' further have longitudinal extensions 76, 77 designed for supporting the additional bottom components 72 when the same are placed between the lateral bottom components 52' and the central bottom component 51'.

Referring to FIGS. 20 to 22, the fourth embodiment of the receptacle according to the invention has a bottom 80 made of a single extensible piece consisting of parallel bars 81 with a formed section, which are connected together by means of spider systems, each one comprising two arms 82, 82' connected together pivotally at their centre and carrying at each end a pivotal member 83, which is mounted slidably in a bottom longitudinal opening 84 of each bar 81 with a formed section (FIG. 22). The bars 81 with a formed section also have a top longitudinal opening 85 with a U-shaped section, of which the upper edges are bent inwards, in the direction of the longitudinal axis of said bar with a shaped section.

The upper openings 85 of the bars 81 with a formed section of the extensible bottom 80 are designed for receiving in the operative position transverse fingers 86, which fingers are integral with sliding members 87 and perpendicular thereto, these sliding members being mounted movably against the inner side of each wall portion forming the wall of said receptacle.

Specifically, each transverse finger 86 has two longitudinal shoulders 86' cooperating in the operative position with the bent portion 85', so that the fingers 86 cannot be removed vertically from the grooves 85.

On the other hand, the external wall of the receptacle is comprised, for example as illustrated in FIG. 21, of four corner components 88, two central wall components 89, two bottom walls 90 forming the lateral ends of the extensible bottom 80, and four extension components 91. Preferably, the upper and lower edges 88', 89' of the wall components 88, 89 are bent in the direction of their inner face so as to form two slides between which are mounted the sliding members 87 to allow the movement of the fingers 86 in a horizontal plane and along the transverse walls of the receptacle. The extension components 91 are designed for adjusting the final length of each side of said receptacle in the desired assembly position.

In this fourth embodiment, the length of the receptacle can be adjusted by stretching or compressing longitudinally the bottom 80 and the width can be adjusted by the sliding motion of the lateral fingers 86 in the bars 81 with a formed section forming said bottom 80.

According to a first alternate version of this fourth embodiment of the receptacle according to the invention, illustrated partly in FIG. 23, the spider arms 82, 82' forming the extensible bottom 80 are mounted slightly differently from their mounting in the embodiment illustrated in FIG. 20: specifically, the pivotal members 83 situated at the ends of said arms 82, 82' are mounted here in the lower longitudinal openings 84 of non adjoining bars 81 with a formed section and the central pivotal member 92 of the arms 82, 82' is mounted in the lower longitudinal opening 84 of an intermediate bar 81 with a formed section.

Finally, FIGS. 24 and 25 are partial cross-sectional views of another version of the extensible bottom in the fourth embodiment, in which the other constituent components are identical to those illustrated in FIG. 21, in particular insofar as the design and the assembling of the transverse fingers and of the wall of the receptacle are concerned.

Specifically, the extensible bottom 95 in this version is formed as a panel 96, made, for example, from polyethylene or polypropylene and exhibiting transverse bars 97 with a formed section defining transverse openings 85 similar to those of the bars 81 with a formed section forming the extensible bottom 80 of FIGS. 20 to 23. Furthermore, this panel 96 exhibits score lines 98 parallel to the bars 97 with a formed section, which make possible a transition from one extreme position corresponding to the full extension of said bottom 95 (FIG. 24) to another position of minimal length of said bottom 95 (FIG. 25), in the manner of bellows, and conversely.

As illustrated in FIGS. 24 and 25, each lateral end of the bellows-shaped extensible and retractable bottom 95 has a wall 90 forming the central portion of the lateral walls of the receptacle.

This version of the receptacle according to the invention is simpler and less expensive to manufacture and allows more flexibility in use, since the adjustment of its dimensions is not dependent, in particular, on the fixed distances between the extension fingers and the hollow bars with a formed section forming the bottom as it is the case in the other embodiments described previously.

What is claimed is:

1. A receptable for multiple uses, having dimensions which can be varied longitudinally and laterally, and which has a peripheral wall, characterised in that it includes a bottom having a carrier surface which is substantially planer; in that said bottom is, on the one hand, extensible longitudinally and/or is provided with longitudinal extension devices with elongate members co-operating slidably therewith; in that said bottom includes, on the other hand, lateral extension devices with elongate members co-operating slidably therewith; and in that the constituent components of the bottom are integral with vertical components capable of a sliding motion with respect to one another to form said peripheral wall, whatever may be the dimensions selected for said bottom.

2. A receptacle according to claim 1, characterised in that it includes a bottom (1, 2; 40) comprised of longitudinal fingers (7, 41), of two longitudinal extension devices (3, 4; 42) and of two lateral extension devices (5, 6; 45) co-operating with said bottom in such a manner as to allow an adjustment of the length and of the width of said receptacle; in that each longitudinal extension device (3, 4; 42) includes fingers (13; 43) integral with a wall (15; 44) and perpendicular thereto, while being spaced apart in such a manner that they may co-operate by sliding telescopically between the longitudinal fingers (7; 41) of the bottom components; in that each lateral extension device (5, 6;45) includes at least one component having fingers (26, 27; 46, 47) integral with a wall (31; 48) and perpendicular thereto, while being arranged in two horizontal planes in such a manner as to co-operate transversally above and beneath the longitudinal fingers (7; 41) respectively of the bottom components and of the longitudinal extension devices; and in that the receptacle is held in an operative position, in which it has a selected length and a selected width, and in which it is held by retainer pieces (37, 38) co-operating with the walls (16, 32) of the longitudinal and lateral extension devices.

3. A receptacle according to claim 2, characterised in that the bottom (40) is made as a single piece comprised of hollow fingers (41) which are U-shaped when viewed in plan and which are held together longitudinally side by side in such a manner that the open end of each finger is contiguous to the closed end of the following finger.

4. A receptacle according to claim 2, characterised in that the bottom is comprised of two components (1, 2) having each one longitudinal fingers (7) which are mutually interdigitated in such a manner as to allow an adjustment of the length of said bottom by bringing together or pulling apart the two components, by telescopically sliding the interdigitated longitudinal fingers, one set with respect to the other; in that the extension devices (3, 4, 5, 6) include each one a main component and two secondary components placed one on each side of the main component; in that the main component (11) and the secondary components (12, 12') of each longitudinal extension device (3, 4) have fingers (13, 17) integral with a wall (15, 16) and perpendicular thereto, which fingers are spaced apart in such a manner that they may co-operate with the longitudinal fingers (7) of the bottom components (1, 2), by sliding telescopically therebetween; in that the main component (24) and the secondary components (25, 25') of each lateral extension device (5, 6) have fingers (26, 27, 33, 34) integral with a wall (31, 32) and perpendicular thereto, these fingers being arranged in two horizontal planes in such a manner as to co-operate transversally above and beneath the longitudinal fingers (7) respectively of the bottom components (1, 2) and of the longitudinal extension devices (3, 4); in that the receptacle is held in the operative position having a selected length and a selected width by four corner pieces (37) co-operating with the walls (16, 32) of the secondary components (12, 12', 25, 25') of the longitudinal and lateral extension devices.

5. A receptacle according to claim 4, characterised in that the fingers (7, 13) of the bottom components (1, 2) and of the main components (11) of the longitudinal extension devices (3, 4) are U-shaped when viewed in plan, so that the fingers (13) of the latter may slide telescopically in the U-shaped cavity (7') of the former; in that the U-shaped cavity (13') of the fingers (13) of said main components (11) communicates with a corresponding opening (15') provided in the wall (15) of these components; in that the fingers (17) of the secondary components (12, 12') of the longitudinal extension devices have the shape of rods, dimensioned so that they may slide through said openings (15') of the wall (15) of said main components (11) and into the cavities (13') of the U-shaped fingers (13) thereof.

6. A receptacle according to claim 5, characterised in that the upper edge of each U-shaped finger (7, 13) of the bottom components (1, 2) and of the main components (11) of the longitudinal extension devices, as well as of the rods (17) of the secondary components (12, 12') thereof, are crenated with crenatures (18, 20) defining between them transverse recesses (19, 21), allowing the transverse sliding of the fingers (26, 27, 33, 34) of the lateral extension devices (5, 6).

7. A receptacle according to claim 6, characterised in that the fingers (26, 27) of the main components (24) of the lateral extension devices (5, 6) are U-shaped when viewed in plan, the cavity defined by this U communicating with a corresponding opening (29, 30) provided in the wall (31) of said main components (24); in that the fingers (33, 34) of the secondary members (25, 25') of the lateral extension devices (5, 6) are shaped as rods dimensioned so that they may slide through said openings (29, 30) of the wall (31) of said main components (24) and into the cavity (26', 27') of the U-shaped fingers (26, 27); and in that the fingers (26, 27) of the main components and the rods (33, 34) of the secondary components of the lateral extension devices (5, 6) co-operate by a transverse sliding motion, on the one hand, with transverse recesses (19, 21) of the fingers (7, 13) of the bottom components (1, 2) and of the main components (11) of the longitudinal extension devices (3, 4), as well as of the rods (17) of the secondary components thereof and, on the other hand, with the recesses between the cross-beams (8) arranged beneath one part of the bottom components (1, 2) and integral with the fingers (7) thereof.

8. A receptacle according to claim 1, characterised in that it includes a bottom (50) comprised of three separate components including a central bottom component (51; 51') and two lateral bottom components (52; 52'), and two lateral-longitudinal extension devices including each one a central extension component (53) and two corner components (54, 55).

9. A receptacle according to claim 8, characterised in that the bottom components are formed from T-section bars (56; 56') maintained parallel to one another by lower transverse beams (57); in that the central component (53) of each lateral-longitudinal extension device has a wall (61) and transverse fingers (62) integral with said wall and perpendicular thereto, which fingers are designed for co-operating in the assembly position with T-section bars of the bottom components by sliding therebetween; and in that the corner components (54, 55) of each lateral-longitudinal extension device have each one two walls (63, 64, 65, 66) perpendicular to each other and transverse fingers (62) integral with one of said walls while being perpendicular thereto and designed for co-operating in the assembly position with the T-section bars of the bottom components by sliding therebetween.

10. Receptacle according to claim 9, characterised in that the lateral bottom components (52; 52') have each one a wall (58, 58') parallel to the T-section bars (56, 56') and forming in the operative position the central portion of the lateral walls of the receptacle, the remaining of the lateral walls being formed by two walls (64, 66) of said corner components (54, 55); in that the longitudinal walls of the receptacle are formed by two other walls (63, 65) of said corner components (54, 55) and by the wall (61) of the central extension component (53); and in that the upper and lower edges of said walls (58, 58'; 64, 66; 63, 65; 61) are bent in such a manner as to provide slides or rails (58', 61', 65', 66') to allow a horizontal sliding motion of one wall into the other.

11. A receptacle according to claim 9, characterised in that the transverse fingers (62) of the constituent components of the lateral-longitudinal extension devices have, along their upper edges, shoulders (68) designed for co-operating in the assembly position with the T-section bars (56, 56') of the bottom components (51, 52; 51', 52'); and in that it includes support members comprising, on the one hand, spars (60) fixed beneath the transverse beams (57) of the bottom components (51, 52; 51', 52') and inner walls (59) extending beneath the T-section bars (56; 56') of these bottom components and, on the other hand, by feet (67) fixed beneath the portion of the transverse fingers (62) of the extension components, adjoining the walls (63, 65) thereof.

12. A receptacle according to claim 8 characterised in that it further includes two additional bottom components (70) comprised of U-section bars (71) held together parallel and side by side, and co-operating each one with two transverse extension components (72) comprised of transverse fingers (73) mounted slidably into said U-section bars of the bottom components; and in that said transverse fingers (73) are integral with a wall (75) and perpendicular thereto, which wall (75) is designed for sliding laterally against the inner face of the wall (61) of said central extension component (53), all these components being arranged in such a manner that the two additional bottom components (70) be placed, in at least one operative position, between said central bottom component (51') and the two lateral bottom components (52') and in at least another operative position, on respectively the central bottom component and on the lateral bottom components contiguous to one another.

13. A receptacle according to claim 1, characterised in that it includes a planar bottom (80; 95) which can be extended longitudinally and which is comprised of an assembly of hollow bars (81; 97) with a formed section co-operating slidably with lateral extension components including transverse fingers (86) mounted to be movable laterally on the inner face of components (88, 89) forming the walls of the receptacle.

14. A receptacle according to claim 13, characterised in that the transverse fingers (86) are each one integral with a sliding member (87), the latter being mounted to be movable laterally between two horizontal slides formed by bending the upper edges and the lower edges of the wall component.

15. A receptacle according to claim 13, characterised in that the walls of the receptacle include four corner components (88), two central components (89), two bottom components (90) forming the lateral ends of the extensible bottom (80, 95) and four extension components (91).

16. A receptacle according to claim 13, characterised in that the hollow bars (81) with a formed section exhibit each one an upper longitudinal cavity (85) designed for receiving, in the operative position, the transverse fingers (86) and a lower longitudinal cavity (84); and in that said parallel hollow bars (81) with a formed section are connected together expandably by spiders comprised of two arms (82, 82') rotatably connected together at their centre and having each of their ends provided with a pivotal member (83) mounted slidably in the lower longitudinal cavity (84) of said hollow bar (81) with a formed section.

17. A receptacle according to claim 16, characterised in that at the central pivotal point of the two arms (82, 82') forming a spider, there is provided a pivotal member (92) mounted slidably in said lower longitudinal cavity (84) of the hollow bar (81) with a formed section.

18. A receptacle according to claim 13, characterised in that the extensible bottom (95) is provided as a bellows-shaped panel (96) extensible longitudinally and exhibiting transverse bars (97) with a formed section defining transverse openings (85) designed for receiving the transverse fingers (86) in the operative position.

* * * * *